US005146718A

United States Patent [19]

Baskett

[11] Patent Number: 5,146,718

[45] Date of Patent: Sep. 15, 1992

[54] HINGED SUPPORT ASSEMBLY FOR DUMPING-TYPE RAIN GUTTERS

[76] Inventor: Theodore N. Baskett, 9514 Portland Ave., Tacoma, Wash. 98441

[21] Appl. No.: 729,981

[22] Filed: Jul. 15, 1991

[51] Int. Cl.[5] ..... E04D 13/00

[52] U.S. Cl. ..... 52/11; 248/48.1; 248/48.2; 16/389

[58] Field of Search ..... 52/11, 12, 16; 248/48.1, 48.2; 16/385, 389, 324, 333; 405/118, 119

[56] References Cited

U.S. PATENT DOCUMENTS

| | | | |
|---|---|---|---|
| 1,041,750 | 10/1912 | Day | 248/48.1 |
| 2,131,985 | 10/1938 | Strayer | 248/48.2 |
| 2,712,915 | 7/1955 | Cohen et al. | 248/48.2 |
| 3,007,662 | 11/1961 | Featheringham | 248/48.2 |
| 3,150,851 | 9/1964 | Ritchie et al. | 248/48.2 |
| 3,630,473 | 12/1971 | Landis | 248/48.2 |
| 4,309,792 | 1/1982 | Faye | 16/389 |
| 4,311,292 | 1/1982 | Deason | 248/48.2 |
| 4,411,108 | 10/1988 | Kerester | 52/11 |
| 4,553,357 | 11/1985 | Pepper | 52/12 |
| 4,669,232 | 6/1987 | Wyatt | 52/11 |
| 4,745,657 | 5/1988 | Faye | 248/48.2 X |
| 4,837,987 | 6/1989 | Fender | 52/11 |

FOREIGN PATENT DOCUMENTS

| | | | |
|---|---|---|---|
| 472139 | 3/1975 | Australia | 248/48.2 |

*Primary Examiner*—David A. Scherbel
*Assistant Examiner*—Creighton Smith
*Attorney, Agent, or Firm*—Eugene D. Farley

[57] ABSTRACT

A hinged support assembly for mounting a swinging and dumping type rain gutter beneath the eaves on the fascia boards. The support comprises a bracket component and a wraparound hanger component mounting the gutters between an operative position wherein they underlie the eaves and an inverted position wherein they discharge their contents and are subject to washing by means of a hose. The support assembly is applicable for use with all of the usual gutter arrangements.

15 Claims, 4 Drawing Sheets

FIG. 7
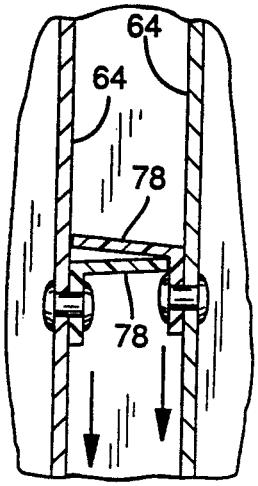
FIG. 6
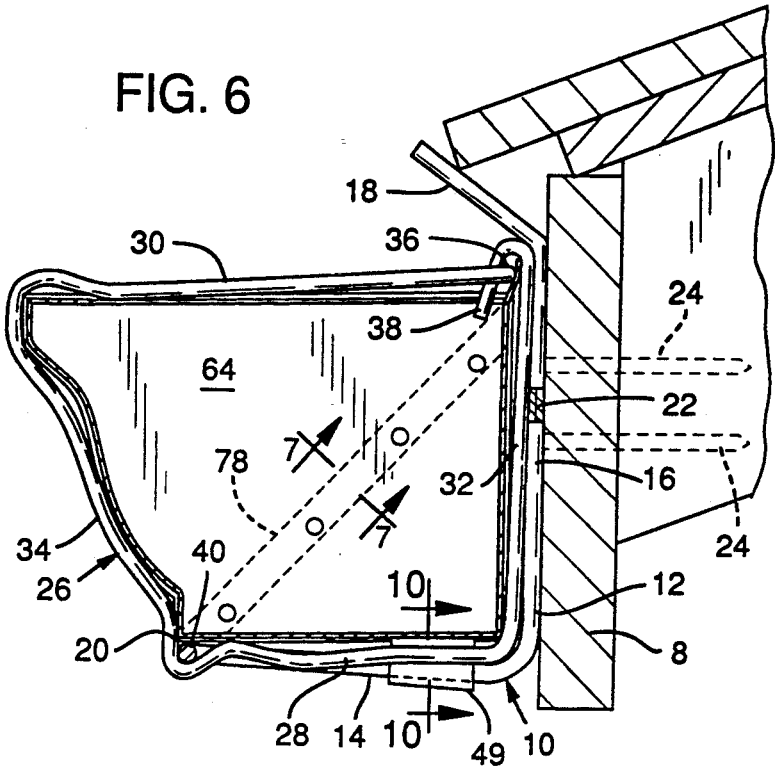
FIG. 10
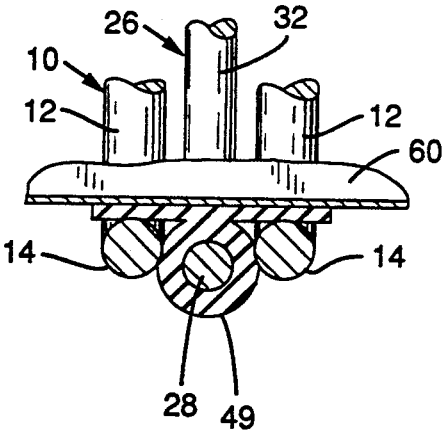
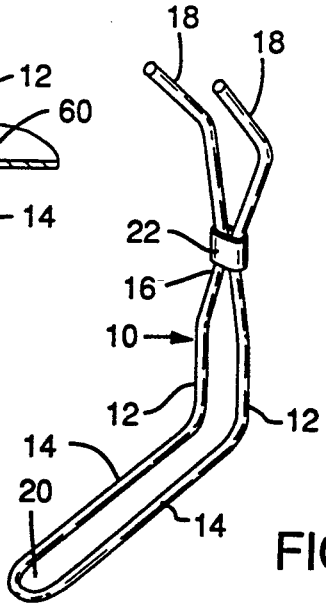
FIG. 8
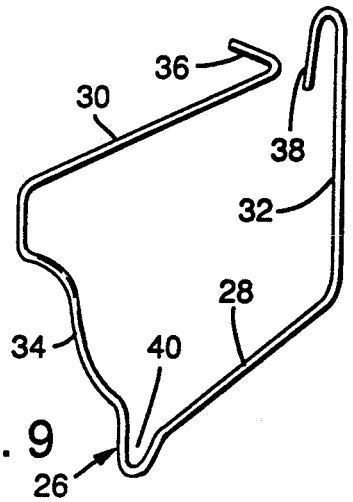
FIG. 9

HINGED SUPPORT ASSEMBLY FOR DUMPING-TYPE RAIN GUTTERS

This invention relates to a hinged support assembly for mounting a swinging and dumping type rain gutter.

BACKGROUND AND GENERAL STATEMENT OF THE INVENTION

The problems associated with cleaning and maintaining a rain gutter assembly mounted beneath the eaves on the usual fascia board or other structural member are well known. It is the general purpose of the present invention to provide a hinged support for such assemblies which has the following advantages:

It provides a hinged support by means of which the gutters may be shifted from an upright, operating position to an inverted dumping and cleaning position, and back again to their operative positions.

It is easily shifted between its two positions by an operator standing on the ground.

When in its operative position, it is secured against inadvertent shifting to its dumping position by excessive wind forces.

It is protected from damage by snow and ice sliding from the roof under adverse climatic conditions.

It is usable with all the usual gutter assemblies employed in the usual patterns of gutter installation, including straight runs, outside corners, and inside corners.

It is simple in construction, inexpensive to manufacture, easy to install and use, and substantially maintenance free during its service life.

The foregoing and other advantages of the invention are achieved by the provision of a hinged gutter support assembly which in its broad aspect comprises a bracket component and a wraparound hanger component, both of which may be manufactured from single lengths of formed wire. The bracket component is nailed or screwed to the fascia boards of the building and provides an eye forming one element of the hinge. The hanger component enters the eye and wraps around the gutter, forming the other element of the hinge. Releasable latch means secure together the two ends of the hanger component.

Detent means interengage either the fascia board or the bracket with the gutter or hanger, for stabilizing the gutter in its operative mode, and preventing it from being blown or otherwise shifted to its inverted, dumping position. However, when it is desired to clean the gutter, a simple maneuver with an appliance operated from the ground may be employed to unlatch the hanger, and invert the gutter, thereby dumping its contents. After cleaning with a hose or otherwise, the gutter may be swung back to its latched, operative position, ready for another term of use.

THE DRAWINGS

In the drawings:

FIG. 6 is a transverse sectional view, illustrating the gutter end cap and associated drip water guide.

FIG. 7 is a sectional detail taken along line 7—7 of FIG. 6.

FIGS. 8 and 9 are detailed, perspective views of the bracket component and hanger component, respectively, of the herein described hinged gutter support assembly.

FIG. 10 is a sectional view taken along line 10—10 of FIG. 6.

DESCRIPTION OF PREFERRED EMBODIMENTS OF THE INVENTION

Figure 1:
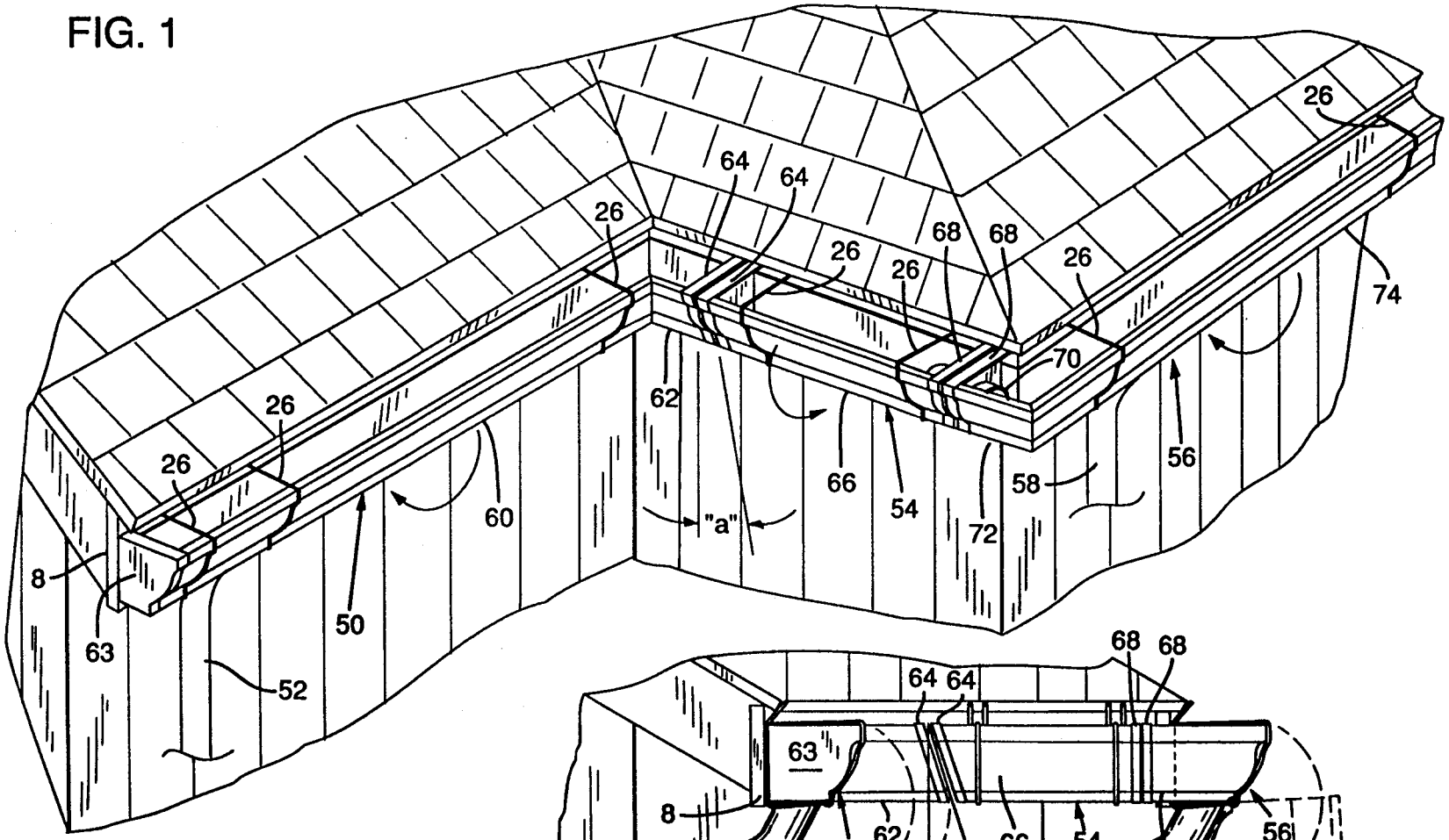
FIG. 1 is a fragmentary top perspective view of a building having mounted thereon the herein described hinged gutter support assembly.

As indicated above, the hinged rain gutter support assembly of my invention basically comprises a bracket component 10 and a wraparound hanger component 26.

The bracket component comprises essentially a vertical segment adapted for positioning against the fascia board 8 to which it is secured, and a horizontal segment adapted to underlie and support the gutter. A hinge eye is provided in the terminal portion of the horizontal segment.

In the preferred embodiment of FIG. 8, the bracket component 10 comprises a single length of sturdy, weather resistant wire reversely bent to form a vertical segment 12, a horizontal segment 14, a waist segment 16 and a shield segment 18.

Horizontal segment 14 is angled upwardly slightly, FIG. 8, to tilt it in such a manner that it biases the gutter inwardly in the direction of fascia board 8. Also, the lengths of the reversely bent wire of which it is made are spaced apart to provide an eye 20 which, forms one of the components of a hinge. The hinge, in turn, makes possible swinging the gutter between an upright, operative, rain-collecting position and an inverted, debris-dumping position, as will be discussed hereinafter.

Waist component 16 of the bracket provides means for securing the bracket to fascia board 8.

Figure 4:
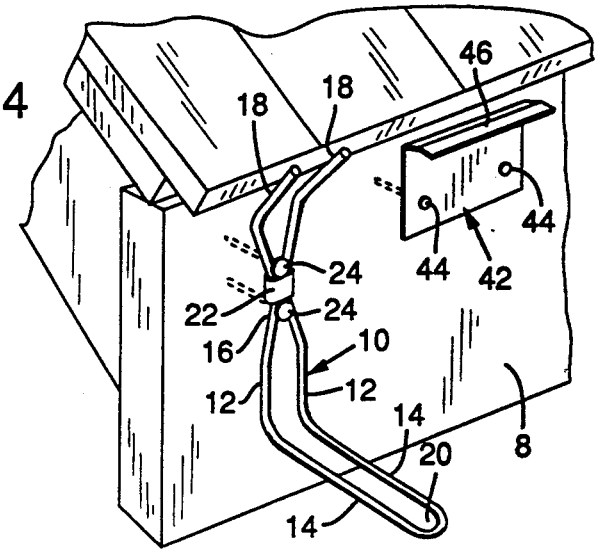
FIG. 4 is a detailed top perspective view illustrating the bracket and fascia board detent components of the invention.

To this end, its component wire lengths are encircled and clamped together by means of a clamp 22. This construction provides openings above and below the clamp through which may be inserted mounting nails or screws 24. These are driven into the supporting fascia board one above and one below the clamp, as illustrated in FIG. 4.

Shield section 18 comprises the upper terminal lengths of wire bent outwardly and upwardly at an angle which establishes clearance for the swing of the gutter, FIG. 6. This is desirable to insure that there will be no interfering shingle projections, branches, or other impediments to hinder the freely swinging movement of the assembly.

The cooperating hanger component 26 broadly comprises an elongated, flexible support member such as a slender rod or strap dimensioned for reception in the eye 20 of the bracket component in hinge-forming relation. It wraps around the gutter with meeting ends which are releasably interengaged by suitable latch means.

A preferred embodiment of the hanger component 26 is shown in FIG. 9.

Like the bracket component 10, it preferably is shaped from a single length of sturdy wire. If desired, it may be encased in a plastic sheath. It comprises a lower horizontal segment 28, an upper horizontal segment 30, an inner vertical segment 32, and an outer substantially vertical segment 34.

The four segments are designed to wrap around the gutter in the illustrated manner.

Thus the bottom horizontal segment 28 underlies and supports the gutter.

The upper horizontal segment 30 overlies the top of the gutter.

The inner vertical segment 32 is positioned along the vertical face of the fascia board.

The outer vertical segment 34 is contoured to the shape of the outer face of the gutter, which it overlies.

The inner end of upper horizontal segment 30 is formed with a hook 36. The upper end of inner vertical segment 32 is formed with a cooperating hook 38. The two hooks are interengageable to form releasable latch means by means of which the hanger component may be latched and unlatched during use of the gutter support assembly.

The adjacent sections of lower horizontal segment 28 and outer vertical segment 34 are formed with a hinge recess 40. This is so located, contoured and dimensioned as to be received in hinge eye 20 of bracket 10 thereby making possible coupling the bracket and hanger components together in hinging relation.

Detent means are provided for releasably securing the gutter to either the supporting fascia board or the supporting bracket. Such means have for their purpose insuring that the gutter will not inadvertently dislodge from its operative, rain-collecting position. Such a mishap might occur, for example, in the event that the gutter assembly is subjected to a strong wind.

Figure 3:
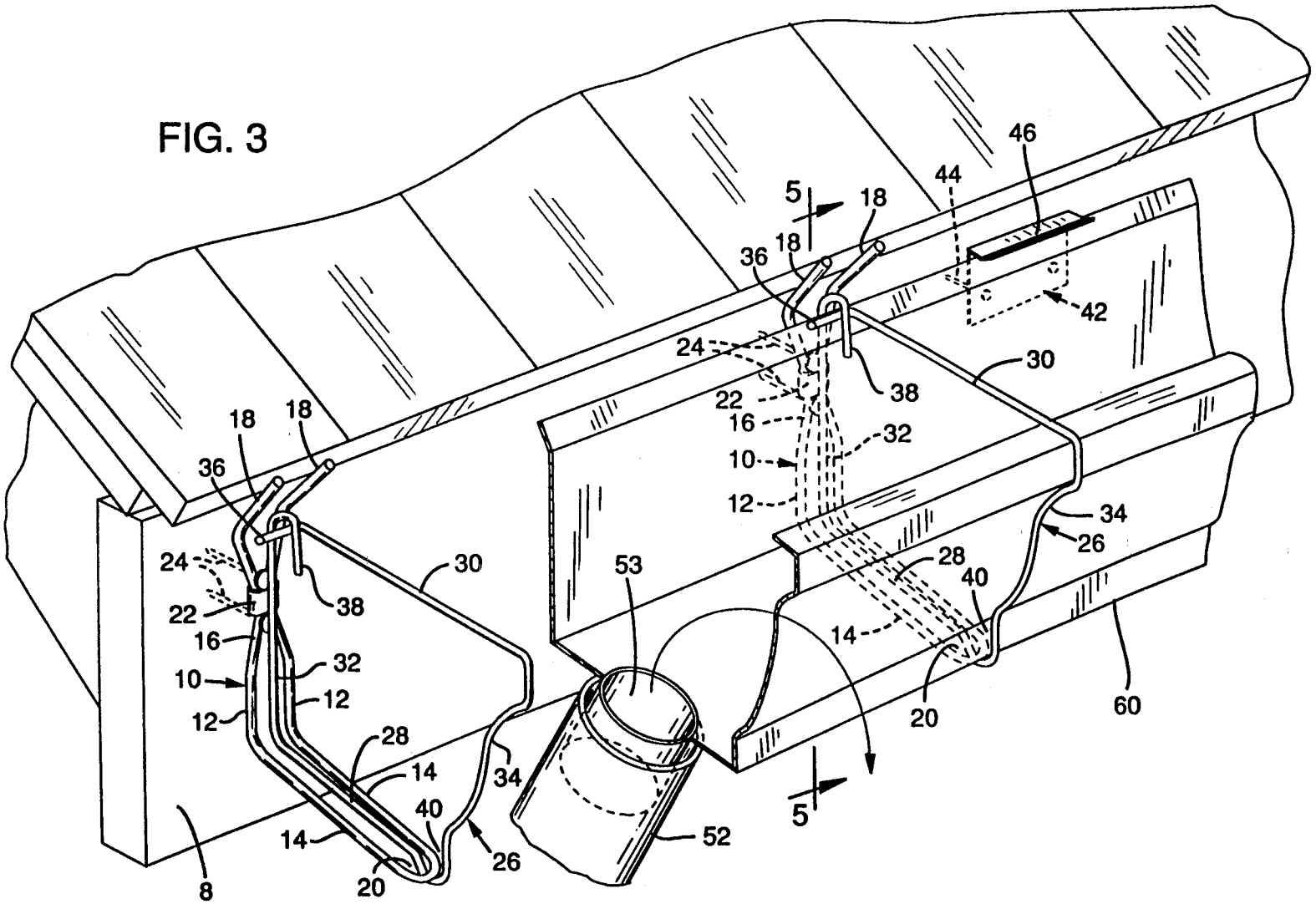
FIG. 3 is a fragmentary, detailed view in top perspective illustrating the bracket and hanger components of the invention and their manner of application to a swinging gutter.

One suitable form of detent means is illustrated in FIGS. 3 and 4. It consists simply of an angularly bent strip of plastic or sheet metal 42 secured by nails 44 to the fascia board in such a position that its friction lip 46 overlies and releasably engages in frictional engagement the inner margin of the gutter.

In another embodiment, illustrated in FIG. 10, the detent 48 comprises a compressible rubber or plastic pad mounted on hanger wire segment 28 and can the underside of the gutter between the component wires of the horizontal segment of bracket 10. It is positioned for releasable frictional engagement with the wires.

The hinged support assembly thus described and illustrated is adaptable for use in conjunction with a variety of rain gutter assemblies, typical of all the situations commonly encountered in building construction. These are illustrated in FIG. 1.

Thus a gutter assembly, indicated generally at 50, has its own downspout 52 and includes an inside angle. Access to the downspout is provided by a vertically arranged stub pipe insert connection indicated at 53.

Gutter assembly 54 comprises a straight run without a downspout.

Gutter assembly 56 has its own downspout 58 and includes an outside constructional angle.

All of the gutter assemblies are supported by the hinged support assemblies 10, 26 of the invention.

All of the gutter assemblies have legs or runs having spaced open ends and are aligned, at least in part, with companion gutter runs.

Thus gutter (eaves trough) assembly 50 includes a first leg 60 welded or otherwise connected to a second leg 62 in inside angle relationship.

A first cap piece 63 seals the outer end of member 60; a second (angled) cap piece 64, the end of member 62. The assembly accordingly is independent, and drains through downspout 52.

Gutter assembly 54 comprises a single straight length of gutter 66. It is capped on one end by means of angled cap piece 64. Since it does not have its own downspout, its other end is capped by means of a modified cap piece 68 which has an opening seating a connecting pipe 70.

The latter member of the assembly communicates gutter 66 with gutter assembly 56, comprising a first leg 72 arranged in outside angle relationship to a second leg 74.

Gutter assembly 56 mounts at its inner end a perforated cap piece 68 which receives the other end of pipe 70, thereby communicating the two adjacent gutter segments so that both may drain through downspout 58.

The adjacent ends of each pair of gutters preferably are spaced apart by an increment of, for example, one-half inch. This is sufficient to permit inclusion in the assembly of means for deflecting water drained from the roof, which otherwise would leak through the joint between the two gutter assemblies. It is desirable to convey this drip water to the drip line on the outer underside of the eaves.

To this end, each mating cap piece may have on its exterior surface an outwardly extending flange 78 extending substantially normal to the cap piece. The flange is arranged at an angle from the upper inner corner of the cap piece to the lower outer corner thereof. Water entering the joint thus will be deflected by the flange to the outer-drip line of the gutter, as desired.

Figure 2:
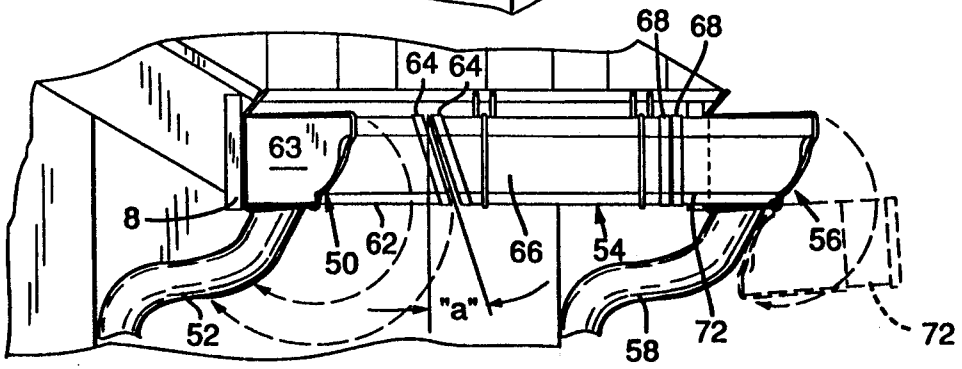
FIG. 2 is a fragmentary, detail elevation illustrating a joint in the gutter assembly of FIG. 1.

To permit free swinging of each inside angle gutter assembly, the cap pieces on the adjacent ends of the gutters, i.e. the "meeting ends," preferably are disposed at an appropriate angle "a" to each other and to the vertical. As shown in FIG. 2, this angle preferably lies within the range of from 4 to 12 degrees from the vertical.

OPERATION

It is a feature of the invention that the gutter assembly may be installed and serviced rapidly and easily without modification of existing techniques.

In the first instance, the installer forms the gutters to dimension and angle, nails or screws brackets 10 to the fascia boards at the predetermined locations and slope, wraps hangers 26 at spaced intervals about the gutters, and hangs the gutters by threading hangers 26 through eyes 20 of the brackets.

Each gutter is swung upwardly to its operative position, in which it is maintained in part by the sloped condition of bracket horizontal section 14, as well as by friction detents 42, 48.

In the event of a heavy load of snow and ice, which might damage the gutter, the gutter swings automatically outwardly and downwardly to dump the load before damage can occur.

Figure 5:
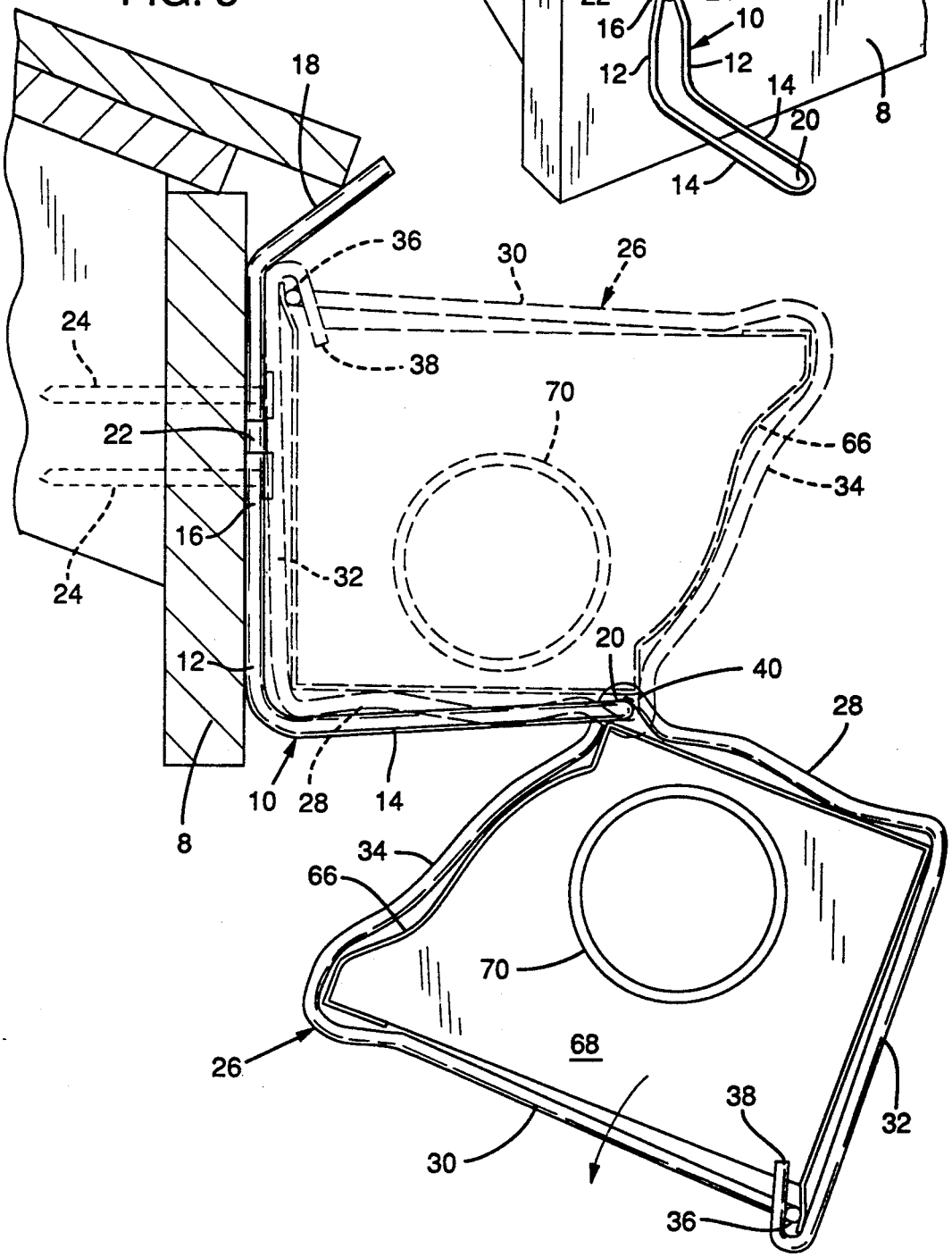
FIG. 5 is a sectional view taken along line 5—5 of FIG. 3, illustrating the swinging and dumping movement of the gutter.

When it is desired to clean the gutters and free them from accumulated debris, this may be accomplished from the ground by the use of a simple hook-type tool mounted on a pole. With the tool, the gutters may be swung from their dashed line operative position of FIG. 5 to their inverted, full line position. This action will discharge the debris from the gutter. Any residual material may be washed out with a hose, after which the gutter may be returned to its upright, operative position.

Having thus described in detail preferred embodiments of the invention, it will be apparent to those skilled in the art that many physical changes may be made in the apparatus without altering the inventive concepts and principles embodied therein. The present embodiments are therefore to be considered in all respects as illustrative and not restrictive, the scope of the invention being indicated by the appended claims.

I claim:

1. A hinged support assembly for mounting a swinging, dumping-type rain gutter beneath the eaves on fascia boards or other structural members, the support comprising a bracket component and a wraparound hanger component, a) the bracket component comprising,
   1) a vertical segment adapted for positioning against the fascia board.
   2) a horizontal segment adapted to underlie the gutter.
   3) securing means for securing the vertical segment to the fascia board, and
   4) a hinge eye in the horizontal segment.

b) the hanger component comprising:
   1) an elongated flexible support member dimensioned for reception in the eye of the bracket component in hinge-forming relation thereto, the hanger component terminating at each end with a meeting end, and to wraparound the gutter with meeting ends, and
   2) latch means releasably interengaging the meeting ends of the flexible support member.

2. The support of claim 1 wherein the bracket component comprises a wire reversely bent to form the hinge eye.

3. The support of claim 1 wherein the bracket component comprises a length of wire reversely bent to form the hinge eye in the horizontal segment of the bracket component and a waist in the vertical segment thereof, and including clamp means clamping together the wire components of the waist to provide on the bracket nailing or screwing locations for securing the same to the fascia board.

4. The support of claim 1 wherein on the upper end of the vertical segment there are provided shield means disposed at an outwardly directed angle predetermined to establish clearance for the swinging motion of the gutter.

5. The support of claim 1 wherein the latch means comprise interengaging hook means.

6. The support of claim 1 wherein the hanger component comprises:

a) a lower horizontal segment,
b) an upper horizontal segment,
c) an inner vertical segment,
d) and an outer vertical segment,
e) and including a recess at the junction of the lower horizontal segment and the outer vertical segment, forming a socket for the reception in hinging relation of the eye of the bracket segment.

7. The support assembly of claim 6 wherein (the bottom bracket segment) is disposed at an inwardly and downwardly sloping angle with reference to inner and outer vertical segments whereby to tilt the gutter inwardly with respect to the fascia board and thereby to increase its stability.

8. The support assembly of claim 6 wherein the hanger component is comprised of a continuous length of formed wire.

9. The support assembly of claim 6 including detent means for preventing inadvertent and untimely swinging and dumping of the rain gutter supported by the assembly.

10. The support assembly of claim 9 wherein the detent means comprises friction clip means releasably interengaging the gutter and the fascia board.

11. The support assembly of claim 9 wherein the detent means comprises friction pad means mounted on the bottom segment of the hanger means and gutter and releasably engageable with the underlying horizontal segment of the bracket means.

12. The support assembly of claim 1 wherein the eaves have an outer drip edge and including in combination a pair of substantially aligned gutters having spaced, adjacent open ends, a cap piece mounted on each of the open ends, and on one of the cap pieces in the space between the gutters an angularly disposed baffle located for guiding drip water from the eaves to the outer drip edge of the gutter.

13. The support assembly of claim 1 including in combination a pair of substantially aligned gutters having open ends, a cap piece mounted on each of the open ends, and conduit means mounted in the cap pieces for conveying water from one of the gutters to the other of the gutters.

14. The support assembly of claim 1 and including in combination a pair of gutters serving an inside angle and comprising a straight length of gutter and an angled length of gutter having two legs, one of the legs of the angled length of gutter being substantially aligned with the straight length of gutter to provide meeting gutter ends, and a cap piece on each of the meeting gutter ends, the gutter ends being angled vertically with reference to each other to provide clearance for the swinging motion of the gutters.

15. The hinged support assembly of claim 14 wherein the angle of the gutter meeting ends is from 4 degrees to 12 degrees with reference to the vertical.

* * * * *